US006267301B1

(12) United States Patent
Haruch

(10) Patent No.: US 6,267,301 B1
(45) Date of Patent: Jul. 31, 2001

(54) AIR ATOMIZING NOZZLE ASSEMBLY WITH IMPROVED AIR CAP

(75) Inventor: James Haruch, Naperville, IL (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 09/491,423

(22) Filed: Jan. 26, 2000

Related U.S. Application Data

(63) Continuation-in-part of application No. 09/330,746, filed on Jun. 11, 1999, now Pat. No. 6,161,778.

(51) Int. Cl.[7] ..... B05B 1/28

(52) U.S. Cl. ..... 239/290; 239/291; 239/298; 239/299; 239/396

(58) Field of Search ..... 239/290, 291, 239/296, 298, 299, 705, 396

(56) References Cited

U.S. PATENT DOCUMENTS

| | | | | |
|---|---|---|---|---|
| 1,587,249 | | 6/1926 | Starr . | |
| 3,907,202 | * | 9/1975 | Binoche | 239/705 |
| 4,055,300 | * | 10/1977 | Binoche | 239/296 |
| 4,537,357 | | 8/1985 | Culbertson et al. . | |
| 4,592,506 | | 6/1986 | Capes et al. . | |
| 4,961,536 | | 10/1990 | Correard . | |
| 5,072,883 | | 12/1991 | Vidusek . | |
| 5,165,605 | | 11/1992 | Morita et al. . | |
| 5,344,078 | | 9/1994 | Firtz et al. . | |
| 5,435,491 | | 7/1995 | Sakuma . | |
| 5,549,246 | | 8/1996 | Kukesh . | |
| 5,732,885 | | 3/1998 | Huffman . | |
| 5,829,682 | | 11/1998 | Haruch . | |
| 5,899,387 | | 5/1999 | Haruch . | |

* cited by examiner

*Primary Examiner*—David A. Scherbel
*Assistant Examiner*—Dinh Q. Nguyen
(74) *Attorney, Agent, or Firm*—Leydig, Voit & Mayer, Ltd.

(57) ABSTRACT

An air assisted spray nozzle assembly having an air cap effective for generating wide, flat spray patterns with improved liquid particle breakdown, utilizing relatively low air flow rates and pressures. The air cap includes a pair of longitudinally extending air passageways on opposite sides of a central liquid flow stream discharge orifice. The air flow passages each have a discharge orifice defined by a respective transverse deflector flange and a closely spaced inwardly tapered deflector surface which cooperate to deflect and guide pressurized air streams inwardly toward the discharging liquid flow stream for atomizing the liquid and for directing it into a well defined spray pattern.

24 Claims, 3 Drawing Sheets

AIR ATOMIZING NOZZLE ASSEMBLY WITH IMPROVED AIR CAP

CROSS-REFERENCE TO RELATED APPLICATIONS

This application is a continuation-in-part of U.S. application Ser. No. 09/330,746, filed Jun. 11, 1999, now U.S. Pat. No. 6,161,778 the disclosure of which is incorporated by reference.

FIELD OF THE INVENTION

The present invention relates generally to air assisted spray nozzles, and more particularly, to an improved air cap for use with air assisted spray nozzle assemblies for enhancing liquid particle breakdown and improving control in the spray distribution.

BACKGROUND OF THE INVETION

In many spray applications, such as humidification or evaporative cooling, it is desirable to generate relatively fine spray particles so as to maximize surface area for distribution in the atmosphere. For this purpose, it is known to use air assisted spray nozzle assemblies in which a pressurized gas such as air is used to break down or atomize a liquid flow stream into very fine liquid particles. For example, in some air assisted nozzle assemblies the liquid is mechanically broken down primarily in an atomizing chamber located in the nozzle assembly upstream from a spray tip or air cap which serves to form the discharging spray pattern. Alternatively, the liquid particle break down can occur in the air cap itself.

From an efficiency and economic operating standpoint it is desirable that such particle breakdown be effected using relatively low air flow rate and pressure. Heretofore this has created problems. In particular, spray tips or air caps which provide efficient and economic operation are generally relatively complex in design, and hence relatively expensive to produce. Moreover, even when extremely fine spray particles are generated and discharged, it can be difficult to direct those particles with the desired control, such as in well defined, relatively wide flat spray patterns.

OBJECTS AND SUMMARY OF THE INVENTION

It is an object of the present invention to provide an air assisted spray nozzle assembly having an improved air cap which is effective for enhanced liquid particle breakdown and improved control in the spray distribution and pattern.

Another object is to provide an air assisted spray nozzle assembly as characterized above in which the air flow rates and pressures may be sufficiently low to be generated by relatively low volume, low pressure fans, in contrast to expensive compressors.

A further object is to provide a spray nozzle assembly of the above kind in which the air cap is effective for generating wide, flat spray patterns with improved control in the liquid particle direction. A related object is to provide such an air cap in which the design can be readily altered to effect the desired width of discharging flat spray pattern.

Still another object is to provide an air cap of the above kind which is simple design and lends itself to economical manufacture. A related object is to provide such an air cap which has precision air and liquid flow passages and deflection surfaces that can be efficiently formed in as few as two machining operations.

These and other features and advantages of the invention will be more readily apparent upon reading the following description of preferred exemplary embodiments of the invention and upon reference to the accompanying drawings wherein:

Figure 1:
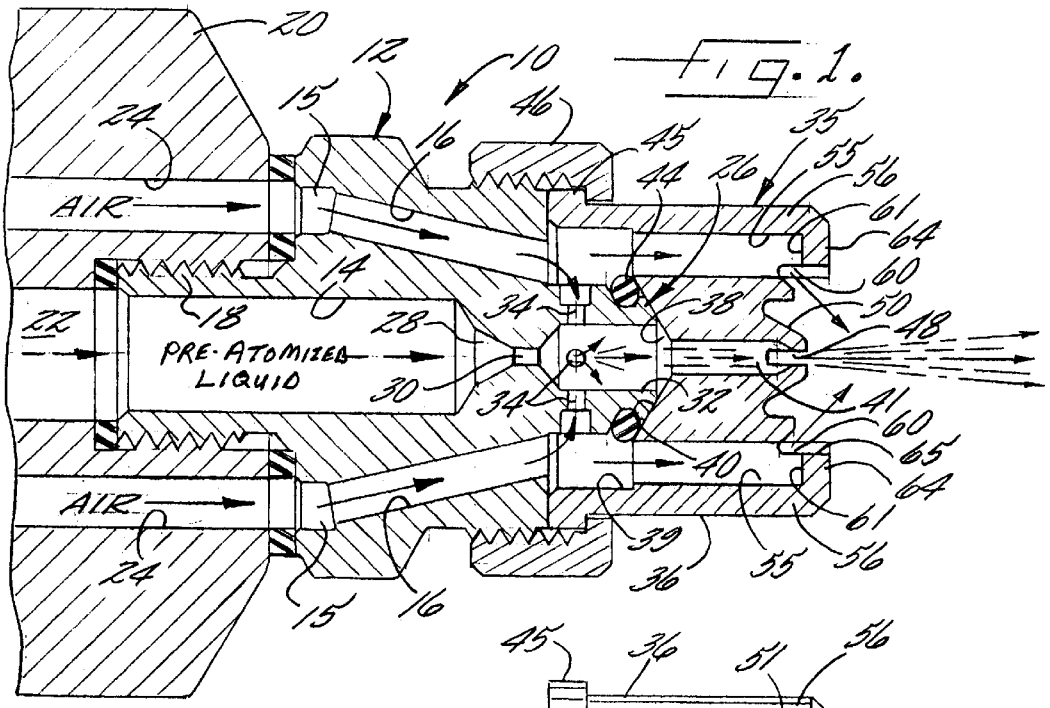
FIG. 1 is a longitudinal section of an illustrative air assisted spray nozzle assembly in accordance with the present invention.
Figure 2:
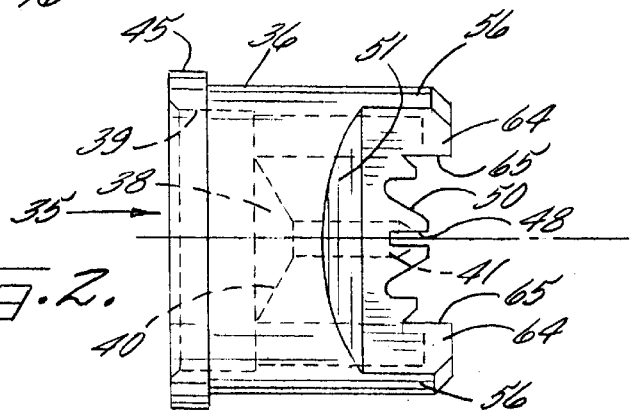
FIG. 2 is a side elevational view of the air cap of the spray nozzle assembly shown in FIG. 1.
Figure 3:
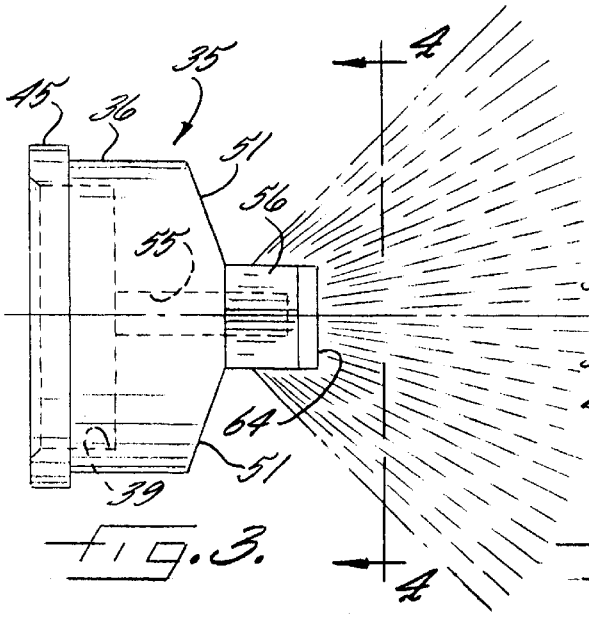
FIG. 3 is a top plan view of the air cap of the spray nozzle assembly shown in FIG. 1, illustrating the relative wide discharging flat spray pattern.
Figure 4:
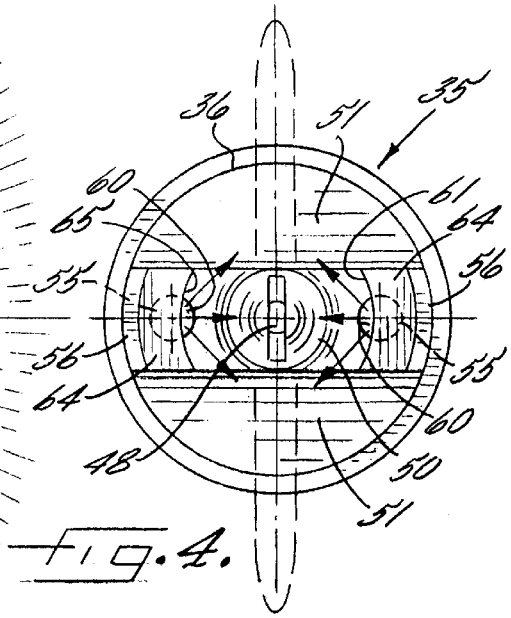
FIG. 4 is an end view of the downstream end of the air cap of the spray nozzle assembly shown in FIG. 3.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to FIG. 1, there is shown an illustrative air assisted spray nozzle assembly 10 embodying the present invention. The nozzle assembly 10 uses a pressurized gas, such as air, to atomize a liquid flow stream into very fine particles so as to maximize surface area. While the present invention is described in connection with particular illustrated spray nozzle assemblies, it will be readily appreciated that the present invention is equally applicable to spray nozzles having different configurations.

The illustrated spray nozzle assembly 10 includes a nozzle body 12 formed with a central liquid inlet passage 14 surrounded by an annular gas passage 15 at an upstream end which communicates with a plurality of forwardly and inwardly extending gas passages 16. The nozzle body 12, in this case, is connected to a base portion 20 of the nozzle assembly 10 via a cylindrical rearwardly extending, externally-threaded extension 18 of the nozzle body 12. The rearward extension 18 of the nozzle body threadedly engages an internally threaded cavity in the base portion 20 such that nozzle body 12 is supported with the liquid and gas inlet passages 14, 15 in communication with the corresponding liquid and gas inlet passages 22,24 in the base portion 20. Liquid and gas inlet ports (not shown) which communicate respectively with the liquid and gas inlet passages 22,24 are provided on the base portion 20. In a known manner, suitable supply lines can be attached to the liquid and gas inlet ports to supply the nozzle assembly 10 with pressurized streams of liquid and gas.

In the embodiment of the invention illustrated in FIG. 1, the nozzle assembly 10 includes a pre-atomizing section 26 defined in large part by a downstream end of the nozzle body 12. The pre-atomizing section 26, in this case, has an inwardly tapered central inlet passage 28 which communicates between the liquid passage 14 and a flow restricting orifice 30 that, in turn, communicates with a cylindrical expansion chamber 32. Pressurized gas in the gas inlet passages 16 is directed to an annular chamber 33, which in turn communicates with the expansion chamber 32 through a plurality of radial air passages 34. Thus, as will be understood by one skilled in the art, the pressurized liquid introduced through the liquid inlet passage 14 is accelerated through the restricting orifice 30 into the expansion chamber 32 where it is broken up and pre-atomized by a plurality of pressurized air streams directed through the radial passages 34. Further details regarding the configuration of the pre-atomizing section are provided in U.S. Pat. No. 5,899,387, the disclosure of which is incorporated by reference. Of course, those skilled in the art will appreciate that other configurations and methods may be employed for pre-atomizing the liquid.

For enhancing atomization and directing the liquid particles into a desired spray pattern, an air cap 35 is mounted immediately downstream of the pre-atomizing section 26. The illustrated air cap 35 in this case has a one-piece construction comprising a cylindrical shell or body 36 formed with an upstream chamber 38 which receives a downstream end of the nozzle body 12. The air cap chamber 38 is defined by an upstream cylindrical portion 39 and a central inwardly tapered or conical portion 40 which communicates with a central fluid flow passageway 41.

The air cap 35 is mounted on the nozzle body 12 with the central fluid flow passageway 41 in communication with the expansion chamber 32 and with the upstream portion of the air cap defining the annular air chamber 33 about the downstream end of the nozzle body 12. The downstream end of the nozzle body 12 is inwardly tapered for mating engagement with the tapered portion 40 of the air cap 35 An 0-ring seal 44 carried in an annular groove about the downstream end of the nozzle body 12 is interposed between the nozzle body 12 and air cap tapered portion 40 for sealing the central fluid flow passageway 41 from the surrounding annular air chamber 33. For securing the air cap 35 to the nozzle body 12, the air cap 35 has an outwardly extending annular retaining flange 45, which is engaged by the annular retaining ring 46 threadedly mounted on an externally threaded annular section of the nozzle body 12.

The central fluid passageway 41 of the air cap 35 communicates with an elongated discharge orifice 48 defined by a cross slot through a conical downstream end portion 50 of the air cap 35 for generating a flat spray pattern. To permit discharge of the flat spray pattern without interference from the air cap 35, the air cap has rearwardly tapered sides 51 on opposite ends of the elongated discharge orifice 48

The air cap 35 is further formed with a pair of diametrically opposed longitudinal air passages 55 communicating downstream from the outer annular chamber 33 such that a portion of the air directed through the passages 16 and to the annular air chamber 33 bypasses the pre-atomizing section 26. The air passages 55 in the illustrated embodiment each extend into a respective forward extension 56 of the air cap 35 and communicate with a respective discharge orifice 60.

Figure 5:
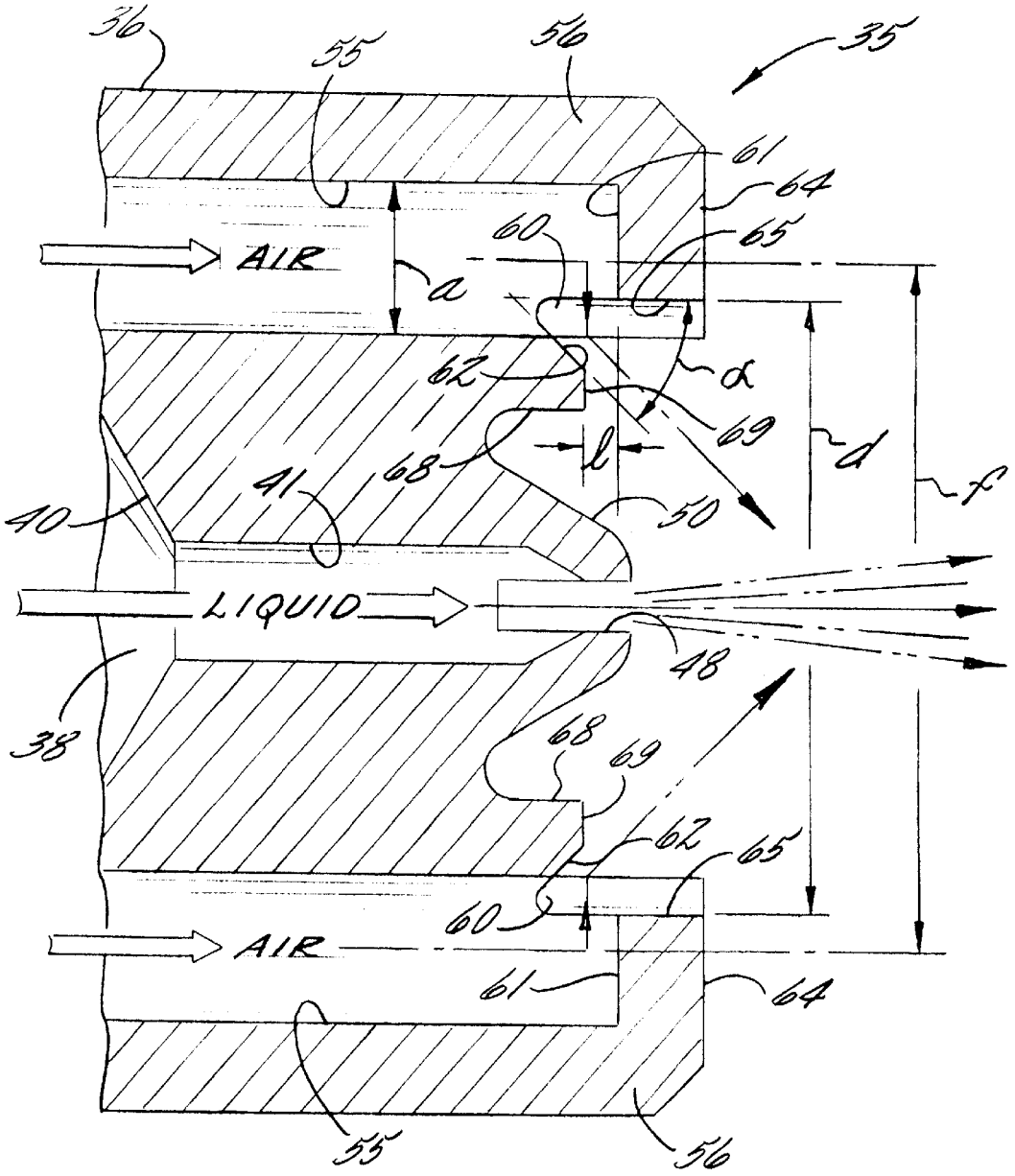
FIG. 5 is an enlarged fragmentary, longitudinal section of the illustrated spray cap showing the interaction of the air and liquid flow streams.
Figure 6:
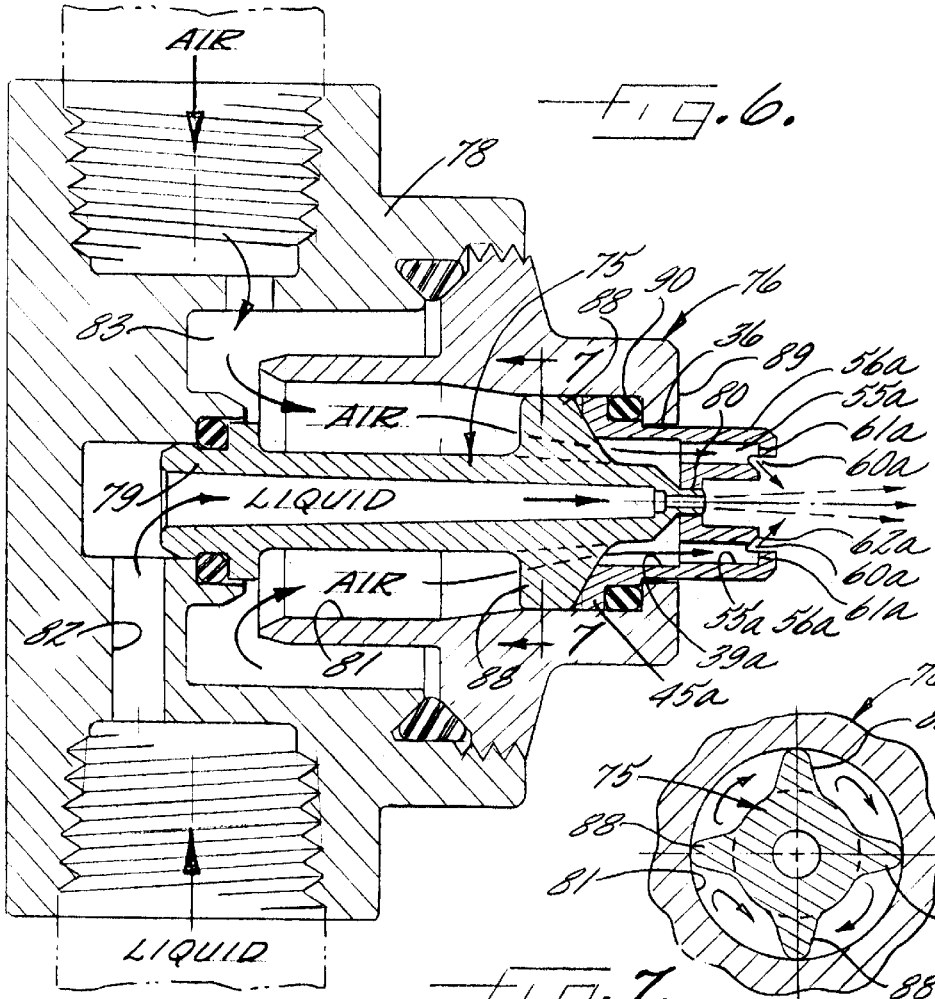
FIG. 6 is a longitudinal section of an alternative embodiment of the spray nozzle assembly according to the present invention.
Figure 7:
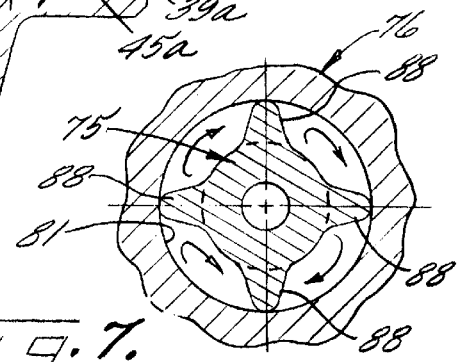
FIG. 7 is a fragmentary section, taken on the plane of line 7—7 in FIG. 6.
Figure 8:
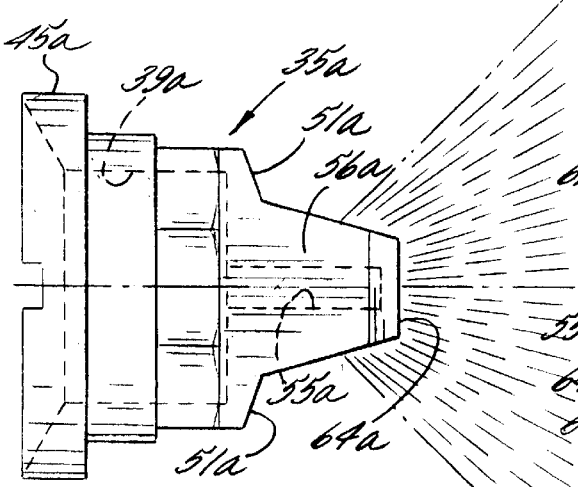
FIG. 8 is a top plan view of the air cap of the spray nozzle assembly shown in FIG. 6, showing the discharging spray pattern.
Figure 9:
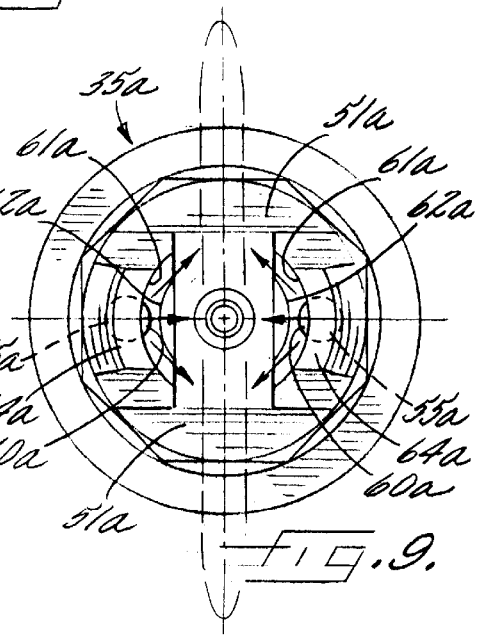
FIG. 9 is an end view of the downstream end of the air cap shown in FIG. 8.

In accordance with the invention, the air cap is designed to direct pressurized air flow streams from the air passage discharge orifices in a manner that enhances further atomization of the pre-atomized flow stream and increases the width of the flat spray pattern in a controlled fashion, while minimizing air flow and pressure requirements. To this end, as shown in FIG. 5, the air cap 35 has transverse or radial deflector surfaces 61, which in combination with inner tapered deflector surfaces 62, direct the pressurized air streams inwardly against opposite sides of the discharging pre-atomized fluid flow stream at a point in relatively close proximity to the central discharge orifice 30. The transverse outer deflector surfaces 61 in this instance are defined by inwardly radial flanges 64 extending transversely at the end of each air passageway 55. The radial flanges 64 have curved outer sides, corresponding to the diameter of the air cap shell 36 and curved inner sides 65 having a diametric spacing "d," as shown in FIG. 5. In order to provide sufficient transverse deflection of the air streams passing through the axial air passages 55 so that at least a portion of the air flow impinges upon and is guided by the inner tapered deflection surfaces 62, the diametric spacing "d" between the inner radial curved sides 65 of the transverse flanges 64 preferably is less than the diametric spacing "f" of the longitudinal axes of the air passages 55, again as illustrated in FIG. 5.

In keeping with the invention, the tapered deflector surfaces 62 extend inwardly in a downstream direction from inner sides of each air passage discharge orifice 60. The tapered deflector surfaces 62 in this case are defined by frustoconical sides of axial extensions 68 of the air cap 35 which terminate with flat ends 69. It can be seen that pressurized air streams passing through the air cap passages 55 will engage the transverse radial deflector surfaces 61 and will be channeled radially inwardly under the guidance of the tapered deflection surfaces 62. Preferably, the size of the air passage discharge orifices 60 are sufficiently small that the combined effect of the transverse and inclined deflector surfaces 61, 62 direct the air in a forceful, but controlled manner, against opposite sides of the discharging fluid flow stream in close proximity to the central discharge orifice 48.

It has been found that optimum spray performance can be achieved, by controlling three important design variables, namely the radial lengths of the transverse deflector flanges as determined by the diameter spacing "d," the distance "l" between axial ends 69 of the deflector surfaces 62 and the transverse flanges 61, and the angle a of the deflector surfaces with respect to the longitudinal axis of the air cap 35. Preferably, as indicated above, the diametric spacing "d" of the ends of the transverse deflector flanges 64 is less than the diametric spacing "f" of the axes of the air passageways 55. Such relationship of the deflection flanges with respect to the air passage axes ensures that the deflector flanges 64 extend radially inwardly at least some distance beyond the axes of the air passageways 55 so as to deflect a substantial portion of the air streams directed through the air passages 55.

The distance "l" between the axial end of the deflector surfaces 62 and the transverse flanges 61 preferably should be maintained relatively small, such as on the order of one-half the diameter "a" of the air passageway 55, or less. Following those design parameters, it has been found that the angle a of the deflector surfaces 62 may be varied depending upon the desired width of flat spray pattern. Increasing the angle a will cause the pressurized air streams to impact the pre-atomized flow stream in closer proximity to the central discharge orifice 48, thereby having greater effect in increasing the width of the flat spray pattern.

Reducing the angle a of the inner tapered deflection surfaces 62 causes the air stream to impact the pre-atomized discharging flow stream at a greater distance than the central discharge orifice 48, and hence, reduce proportionately the width of the spray pattern. Because of transverse deflection surfaces 61, however, for all angles of a of the deflector surfaces 62, the impact of the air streams enhance atomization and influence the width of the discharging spray pattern. Hence, it can be seen that the design of the air cap 35 can be readily customized for particular spray applications through variance of the angle in the inner tapered deflection surfaces 62.

In practice, it further has been found spray nozzles assemblies having air caps 35 according to the present invention can be efficiently operated at relatively low air pressure and flow rates. Effective atomization and flat spray pattern control can be achieved at air pressures of less than 10 psi and at air flow rates of as low as 3 s.c.f.m. Under such operating conditions, it is possible to use relatively low cost fans for air generation, in contrast to costly compressors typically required in industrial applications.

A person skilled in the art will further appreciate that the air cap 35 of the present invention, while adapted for highly efficient usage in air assisted spray nozzle assemblies, yet lends itself to very economical manufacture. Indeed, the air passages 55 can be machined from an upstream side of the air cap by flat bottom drills, while the downstream end of the air cap can be efficiently machined by conventional trepan tooling to form the deflection surfaces and the discharge orifices. Hence, the precision discharge orifices and deflection surfaces can be formed in as few as two machining operations. Alternatively, the air cap design further lends itself to economical plastic injection molding, by permitting the mold to be pulled apart in axial directions.

Referring now to FIGS. 6–9, there is shown an alternative embodiment of the invention wherein items similar to those described above have been given similar reference numerals with the distinguishing suffix "a" added. The spray nozzle assembly 10*a* includes a nozzle body having a liquid direction member 75, in lieu of a pre-atomization section, such that a liquid flow stream is discharged directly into the air cap, without prior air atomization, for interaction by opposing pressurized air streams external of the air cap 35*a* in the manner described above. The illustrated liquid supply member 75 is supported within an annular forward body member 76 which is threadedly engaged with a main body member 78 to which air and liquid supply lines can be attached. The liquid supply member 75 has an upstream end 79 communicating with a liquid supply passage 82 and a downstream, reduced diameter end 80 fit within a central aperture of the air cap 35*a*. The liquid direction member 75 is supported within an upstream chamber 81 of the nozzle body member 76 which communicates with an air supply passage 83. The liquid direction member 75 is supported within the chamber 85 by a plurality of radially disposed fins 88 that permit the axial flow of air therebetween to the air cap 35*a*.

The air cap 35*a* in this instance is secured to the forward nozzle body member 76 between the wings 88 of the liquid supply member 75 and the annular flange 89 of the nozzle body member 76 with an O-ring seal 90 interposed between the flange 89 and air cap retaining flange 45*a*. Similar to the embodiment described above, the air cap 35*a* has a pair of diametrically opposed air passages 55*a*, each communicating with a respective discharge orifice 60*a* which direct pressurized air streams into impacting contact with opposed sides of the discharging liquid flow stream. Similar to the previous embodiment, the air cap 35*a* has transverse and tapered deflector surfaces 61*a*, 62*a* which directs the air streams in a controlled manner inwardly against the liquid flow stream to enhance liquid atomization and to increase the width discharging flat spray pattern.

From the foregoing, it can be seen that the air assisted spray nozzle assembly of the present invention has an improved air cap which is effective for enhanced liquid particle breakdown and improved control in spray distribution and pattern, while requiring relatively low air pressure and flow rates that can be generated by low cost fans and blowers. The air cap further is effective for generating wider, flat spray patterns with improved control and liquid particle direction. While the air cap includes precision discharge orifices and air deflection surfaces, it lends itself to economical manufacture, through machining and/or plastic injection molding.

What is claimed is:

1. An air assisted spray nozzle assembly comprising:

a nozzle body having a liquid inlet passage and a gas inlet passage, an air cap disposed downstream of said nozzle body, said spray nozzle assembly having a liquid discharge orifice in communication with said liquid inlet passage for discharging a liquid flow stream axially through said air cap, said air cap having a pair of diametrically opposed and longitudinally extending air passages on opposite sides of said liquid discharge orifice, said air passages each having a transverse deflector flange at an axial end of the air passage, said air cap including a pair of inwardly tapered deflector surfaces, each tapered deflector surface being opposite a respective one of the transverse deflector flanges and extending at an acute angle relative to the portion of the longitudinal axis of a respective one of said air passages downstream from said deflector surfaces, and said deflector flanges having inner radial sides which are diametrically spaced apart a distance less than the diametric spacing of the axes of said longitudinal air passages such that substantial portions of the air streams directed through said air passages impinge said transverse deflector flanges and are directed into inward impacting relation with opposite sides of the discharging liquid flow stream for atomizing the liquid flow stream and directing it into a predetermined spray pattern.

2. The spray nozzle assembly of claim 1 in which said deflector surfaces each extend inwardly in a downstream direction from an inner radial side of a respective air passage discharge orifice.

3. The spray nozzle assembly of claim 1 in which said deflector flanges are spaced axially downstream from axial ends of said tapered deflection surfaces a distance no greater than one-half the diameter of said air passages.

4. The spray nozzle assembly of claim 1 in which said deflector flanges have opposed curved sides having a diameter of curvature corresponding to the diametrical spacing between the deflector surfaces.

5. The spray nozzle assembly of claim 1 in which said liquid discharge orifice has an elongated configuration for discharging a flat spray pattern, and said air passage discharge orifices direct air streams against opposite sides of the discharging liquid spray for increasing the width of the flat spray pattern.

6. The spray nozzle assembly of claim 5 in which said liquid discharge orifice is defined by a cross slot in a downstream axial extension of said air cap.

7. The spray nozzle assembly of claim 1 in which said air passage discharge orifices each are defined by an inner radial side of one of said transverse deflector flanges and an outer radial side of a deflector surface tapered at an acute angle to a longitudinal axis of said air cap.

8. The spray nozzle assembly of claim 7 in which said tapered deflector surfaces each are defined by an outer curved side of a respective frustoconical downstream extension of said air cap.

9. The spray nozzle assembly of claim 1 in which said nozzle body includes a pre-atomizing section within which pressurized streams of liquid and air introduced into said liquid and gas inlet passages are forcefully intermixed to pre-atomize the liquid, and said liquid discharge orifice is in communication with said atomizing section for discharging said pre-atomized liquid flow stream through said air cap.

10. The spray nozzle assembly of claim 9 in which said liquid discharge orifice is formed centrally within said air cap and is in fluid communication with said pre-atomizing section for discharging a pre-atomized liquid flow streams axially through the air cap.

11. The spray nozzle assembly of claim 1 including a liquid supply member mounted within said nozzle body having an upstream end in fluid communication with said liquid inlet passage and a downstream end disposed axially within said air cap for directing a pressurized liquid flow stream axially through said air cap.

12. An air assisted spray nozzle assembly comprising:

a nozzle body having a liquid inlet passage and a gas inlet passage, an air cap disposed downstream of said nozzle body, said spray nozzle assembly having a liquid discharge orifice in communication with said liquid inlet passage for discharging a liquid flow stream axially through said air cap, said air cap having a pair of diametrically opposed and longitudinally extending air passages on opposite sides of said liquid discharge orifice, said air passages each having a transverse deflector flange for deflecting air directed through said air passageways radially inwardly, said air cap including a pair of inwardly tapered deflector surfaces, each tapered deflector surface extending radially inwardly in a downstream direction at an acute angle relative to the portion of the longitudinal axis of a respective one of said air passages downstream from said deflector surfaces, and said deflector surfaces being opposite a respective one of the transverse deflector surfaces for guiding air directed inwardly by the transverse deflector surfaces toward the discharging liquid flow stream for atomizing the liquid flow stream and directing it into a predetermined spray pattern.

13. The spray nozzle assembly of claim 12 in which said deflector surfaces each extend inwardly in a downstream direction from an inner radial side of a respective air passage discharge orifice.

14. The spray nozzle assembly of claim 13 in which said air passage discharge orifices each are defined by an inner radial side of one of said transverse deflector flanges and an outer radial side of one of said tapered deflector surfaces.

15. The spray nozzle assembly of claim 14 in which said tapered deflector surfaces each are defined by an outer curved side of a respective frustoconical downstream extension of said air cap.

16. The spray nozzle assembly of claim 12 in which said nozzle body includes a pre-atomizing section within which pressurized streams of liquid and air introduced into said liquid and gas inlet passages are forcefully intermixed to pre-atomize the liquid, and said liquid discharge orifice is in communication with said atomizing section for discharging said pre-atomized liquid flow stream through said air cap.

17. The spray nozzle assembly of claim 16 in which said liquid discharge orifice is formed centrally within said air cap and is in fluid communication with said pre-atomizing section for discharging a pre-atomized liquid flow streams axially through the air cap.

18. The spray nozzle assembly of claim 12 in which said deflector flanges are spaced axially downstream from axial ends of said tapered deflection surfaces a distance no greater than one-half the diameter of said air passages.

19. The spray nozzle assembly of claim 12 in which said liquid discharge orifice has an elongated configuration for discharging a flat spray pattern, and said air passage discharge orifices direct air streams against opposite sides of the discharging liquid spray for increasing the width of the flat spray pattern.

20. The spray nozzle assembly of claim 19 in which said liquid discharge orifice is defined by a cross slot in a downstream axial extension of said air cap.

21. The spray nozzle assembly of claim 12 including a liquid supply member mounted within said nozzle body having an upstream end in fluid communication with said liquid inlet passage and a downstream end disposed axially within said air cap for directing a pressurized liquid flow stream axially through said air cap.

22. An air assisted spray nozzle assembly comprising:

a nozzle body having a liquid inlet passage and a gas inlet passage, an air cap disposed downstream of said nozzle body, said spray nozzle assembly having a liquid discharge orifice in communication with said liquid inlet passage for discharging a liquid flow stream axially through said air cap, said air cap having a pair of diametrically opposed and longitudinally extending air passages on opposite sides of said liquid discharge orifice, said air passages each having a discharge orifice defined by an inwardly directed transverse radial flange at the end of the air passage and an inwardly tapered deflector surface on an inner radial side extending at an acute angle relative to a longitudinal axis of the air passage downstream from said deflector surface, and said transverse deflector flanges and tapered deflector surfaces cooperating to direct air radially inwardly toward a discharging liquid flow stream for atomizing the liquid flow stream and directing it into a predetermined spray pattern.

23. The spray nozzle assembly of claim 22 in which said deflector flanges are spaced axially downstream from axial ends of said tapered deflection surfaces a distance no greater than one-half the diameter of said air passages.

24. An air assisted spray nozzle assembly comprising:

a nozzle body having a liquid inlet passage and a gas inlet passage, an air cap disposed downstream of said nozzle body, said spray nozzle assembly having a liquid discharge orifice in communication with said liquid inlet passage for discharging a liquid flow stream axially through said air cap, said air cap having a pair of diametrically opposed and longitudinally extending air passages on opposite sides of said liquid discharge orifice, said air passages each having a transverse deflector flange for deflecting air directed through said air passageways radially inwardly, said air cap including a pair of inwardly tapered deflector surfaces extending radially inwardly in a downstream direction at an acute angle relative to the portion of the longitudinal axis of a respective one of said air passages downstream from said deflector surfaces, said tapered deflector surfaces each being opposite a respective one of the transverse deflector flanges for guiding air directed inwardly by the transverse deflector flanges toward the discharging liquid flow stream for atomizing the liquid flow stream and directing it into a predetermined spray pattern, and said deflector flanges being spaced axially downstream from axial ends of said tapered deflection surfaces a distances no greater than one-half the diameter of said air passages.

* * * * *